US008403598B2

(12) United States Patent
Thomas

(10) Patent No.: US 8,403,598 B2
(45) Date of Patent: Mar. 26, 2013

(54) PILE SAVER

(76) Inventor: William Frederick Thomas, Ocean Isle Beach, NC (US)

( * ) Notice: Subject to any disclaimer, the term of this patent is extended or adjusted under 35 U.S.C. 154(b) by 60 days.

(21) Appl. No.: 13/022,444

(22) Filed: Feb. 7, 2011

(65) Prior Publication Data

US 2011/0194899 A1 Aug. 11, 2011

Related U.S. Application Data

(60) Provisional application No. 61/301,676, filed on Feb. 5, 2010.

(51) Int. Cl.
*E02D 5/60* (2006.01)

(52) U.S. Cl. ..... 405/211.1; 405/216

(58) Field of Classification Search ..... 405/211, 405/211.1, 216
See application file for complete search history.

(56) References Cited

U.S. PATENT DOCUMENTS

| | | | | |
|---|---|---|---|---|
| 934,176 | A | 9/1909 | Hubbard | |
| 1,134,881 | A * | 4/1915 | Lockwood | 405/211 |
| 3,170,299 | A * | 2/1965 | Clarke | 405/61 |
| 3,486,342 | A | 12/1969 | Aks | |
| 4,357,891 | A | 11/1982 | Sluys | |
| 4,415,293 | A | 11/1983 | Engel et al. | |
| 4,512,683 | A * | 4/1985 | Cosenza | 405/216 |
| 5,435,667 | A | 7/1995 | Strange | |
| 5,829,920 | A | 11/1998 | Christenson | |
| 5,937,781 | A | 8/1999 | Isella et al. | |
| 6,364,575 | B1 * | 4/2002 | Bradley et al. | 405/216 |
| 7,188,579 | B2 | 3/2007 | Lemonides | |
| 7,451,784 | B2 | 11/2008 | Goddard | |
| 7,617,792 | B1 * | 11/2009 | Pursley | 405/211 |
| 2004/0240945 | A1 * | 12/2004 | Frantz | 405/216 |
| 2007/0215028 | A1 * | 9/2007 | Lie | 405/211 |
| 2010/0021240 | A1 * | 1/2010 | Castrogiovanni | 405/216 |

OTHER PUBLICATIONS

ADS, "Waterstop Grout Ring Connection Detail", Jul. 23, 2009.

* cited by examiner

*Primary Examiner* — Frederick L Lagman
(74) *Attorney, Agent, or Firm* — Monty Simmons; Simmons Patents

(57) ABSTRACT

A floating pile saver device that prevents substantial growth of marine life on a pile installed in a marine environment. The device is configurable to be associated with piles that have a plurality of pile shapes. The pile saver may also providing additional useful features and functions such as mooring functions and electronic monitoring and communications functions. The pile saver device is configured to be movably associated with a pile so that such pile saver can float and rub a section of the surface of said pile as the water level changes (e.g. due to tidal variations in water level). Such rubbing prevents marine growth attachment along the "rub area". Alternative embodiments of the invention provide numerous additional features including: (a) mooring a vessel, (b) providing a mooring bumper to protect the boat moored to the invention, (c) a platform, and (d) electronic features.

20 Claims, 11 Drawing Sheets

PILE SAVER

CLAIM TO PRIORITY

This application claims priority to provisional application No. 61/301,676 filed on Feb. 5, 2010, the entire contents of which are incorporated by this reference for all that it discloses.

TECHNICAL FIELD OF THE INVENTION

The present invention relates to an apparatus and method of extending the useful life of a marine pile by preventing marine growth on such pile.

BACKGROUND OF THE INVENTION

Piles are common in marine environments (hereafter "piles" or "marine piles") and perform a variety of useful functions such as providing a fixed location for mooring a vessel, presenting location information, as well as supporting marine structures. Marine Piles may be constructed of various materials including steel and wood. Since marine piles are typically driven into the ground and come in direct contact with air, dirt, and water, there are several different "deterioration zones" including the: (1) atmospheric zone; (2) splash zone; (3) intertidal zone; (4) continuous immersion zone; and (5) underground zone. Each zone has its own deterioration factors that need to be considered when considering how to extend the useful life of a marine pile.

The problem of marine growth on marine pilings has been in existence since mankind has built structures in water. Marine growth such as barnacles, oysters, algae, and several for other organisms and fungi, latch onto marine pilings and pose several problems including promoting rot thereby shortening their useful life. Indeed, for marine piles, marine growth has a considerable influence on the protective measures needed to prevent premature structural failure.

For metal marine pilings, studies have shown that there is almost no Marine growth in the atmospheric and splash zones, but in the intertidal and continuously emerged zones heavy growth of barnacles and weeds can develop. Notably, for metal piles, the splash zone and the intertidal zone experience the most severe corrosion. Similarly, for wood piles, marine growth on the intertidal zone is of great concern.

For wood marine pilings, the industry has tried to alleviate this problem using several prior art methods including piling wraps and treated paints. Piling wraps designs include vinyl sheets that are wrapped around a marine piling to keep marine growth from forming. Such wraps are relatively expensive and look unsightly when the marine piling is not nearly perfectly straight. Additionally, if such piling wrap becomes cut anywhere, the Marine growth can and does find its way to the piling and attaches itself.

Treated paints have also been tried for preventing marine growth in the intertidal zones of wood marine piles and the underside of water vessels. For such method various chemical additives are put into paints for application onto a marine object (such as pilings and boats). Unfortunately, such paints can leech dangerous chemicals into the water, do not last long, and are very expensive.

Charles Hubbard disclosed a device or protecting the pile in U.S. Pat. No. 934,176 (incorporated by this reference for all that it discloses). Such device was configured for automatically applying a preservative along the length of a pile by the aid of the rise and fall of water. The device consisted of a floating casting associated with a pile configured to freely move up and down the pile with the level of the water where the upper portion of the casting was liquid tight for containing a preservative solution. The casting provided an inner space between the casting and the pile. Such inner space is filled with a preservative solution, such as crude oil, that is applied to the pile as the casting moves up and down. Such a device requires the refilling of a preservative solution and provides minimal rubbing the fact between the casting and the pile.

Sluys teaches a floating mooring device in U.S. Pat. No. 4,357,891 (incorporated by this reference for all that it discloses) that is fastened to a cylindrical collar that loosely surrounds a pile so that it may moves upwardly or downwardly along the pile in response to tidal action. Such device works well for providing a mooring function for round piles.

Isella et al. (U.S. Pat. No. 5,937,781; incorporated by this reference for all that it discloses) teach a floating piling attachment device with shock absorbing capability which also allows a watercraft moored to such device to rise and drop vertically with water level variations. As taught by Sluys, Isella et al. teach a device that loosely fits over and around the mooring point. The Isella et al. device is configured to a mooring device that minimizes damage to a watercraft moored to such device caused by impact and scraping against a pier or piling while also floating thereby maintaining the same relative distance between the watercraft and the mooring point.

Lemonides teaches a mooring pole line attachment device in U.S. Pat. No. 7,188,579 (incorporated by this reference for all that it discloses) comprising a tubular section associated with buoyant base. Such device provides a point of mooring for a boat that moves up and down with changes in water level while providing protection for both boat and mooring pole. Similar to the Sluys device and the Isella et al. device, the Lemonides devices provides a floating mooring function for round piles.

What is needed is a cost effective floating device that prevents the substantial growth of marine life on a pile that may be used with a plurality of pile shapes while also providing additional useful features and functions such as mooring functions and electronic monitoring and communications functions.

SUMMARY

Some of the objects and advantages of the invention will now be set forth in the following description, while other objects and advantages of the invention may be obvious from the description, or may be learned through practice of the invention.

Embodiments of the present invention addresses the problem of premature failure of a marine pile due to marine growth on such pile by providing a pile saver device comprising a pile surface interface configured to associate with the surface of a pile and prevent/remove marine growth from the exterior surface of such piling. The pile saver device is configured to float thereby allowing the pile surface interface to continuously rub a section of a pile surface as the water level changes (e.g. due to tidal variations in water level) thereby preventing Marine growth attachment along the "rub area" (e.g. in the intertidal zone as described later in this document). Alternative embodiments of the invention provide numerous additional features including: (a) mooring a vessel, (b) providing a mooring bumper to protect the boat moored to the invention, (c) a platform, and (d) electronic features.

Broadly speaking, a principle object of the present invention is to provide an pile saver apparatus comprising an adjustable shell wherein the inside surfaces define at least one pile-interface and the outside surface defines an exterior-shell-interface and wherein such shell defines a polygonal shape consistent with the polygonal shape defined by the parameter of a pile. The adjustable shell is configured so that the shell's parameter is a predefined amount larger than the parameter defined by the pile allowing the pile-interface to be snugly, or loosely, associated with at least a portion of the exterior surface of the pile. The shell may be constructed of buoyant material, or alternatively, shell may be configured for being associated with a buoyant material. For one embodiment, the shell is configured for being associated with a housing that provides both a buoyant force and a protection function. For such configuration, the shell, the housing, or both, may be constructed of buoyant material.

Yet another object of the invention is to provide for a pile saver apparatus configured with electronic module configured for performing a predefined function. Such electronic features include: (1) generating visual signals, (2) generating audio signals, (3) monitoring an environmental parameter and generating sensor data representative of an environmental parameter including: location data, acceleration, water level, light level, sound data, visual data, temperature, and animal.

Additional objects and advantages of the present invention are set forth in the detailed description herein or will be apparent to those skilled in the art upon reviewing the detailed description. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

For the purposes of this document two or more items are "mechanically associated" by bringing them together or into relationship with each other in any number of ways including a direct or indirect physical connection that may be releasable (snaps, rivets, screws, bolts, etc.) and/or movable (rotating, pivoting, oscillating, etc.). Similarly, two or more items are "electrically associated" by bringing them together or into relationship with each other in any number of ways including: (a) a direct, indirect or inductive communication connection, and (b) a direct/indirect or inductive power connection.

Additional embodiments of the present subject matter, not necessarily expressed in this summarized section, may include and incorporate various combinations of aspects of features or parts referenced in the summarized objectives above, and/or features or components as otherwise discussed in this application.

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
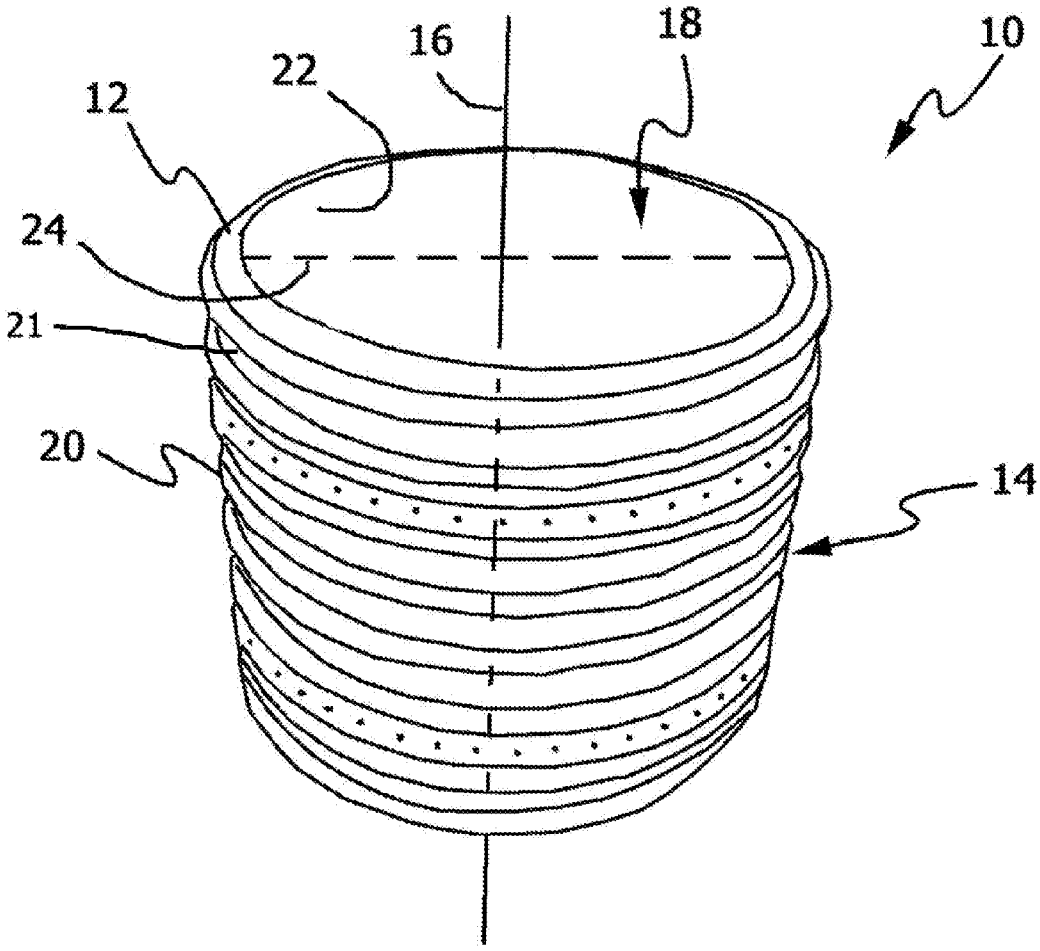
FIG. 1 is a side perspective view of one exemplary embodiment of a pile saver.

Repeat use of reference characters throughout the present specification and appended drawings is intended to represent the same or analogous features or elements of the present technology.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

For the purposes of this document two or more items are "mechanically associated" by bringing them together or into relationship with each other in any number of ways including a direct or indirect physical connection that may be releasable (snaps, rivets, screws, bolts, etc.) and/or movable (rotating, pivoting, oscillating, etc.) Similarly, two or more items are "electrically associated" by bringing them together or into relationship with each other in any number of ways including: (a) a direct, indirect, wireless, or inductive communication connection, and (b) a direct/indirect or inductive power connection. Additionally, while the drawings may illustrate various electronic components of a system connected by a single line, it will be appreciated that such lines may represent one or more signal paths, power connections, electrical connections and/or cables as required by the embodiment of interest.

While the specification may contain headers, such headers are simply place markers and do not form a part of the specification and are not to be used in the construction of the specification.

While the particulars of the present invention and associated technology may be adapted for use with piles in any environment, the examples discussed herein are primarily in the context of a sea water environment subject to tidal variations in water level.

Figure 2:
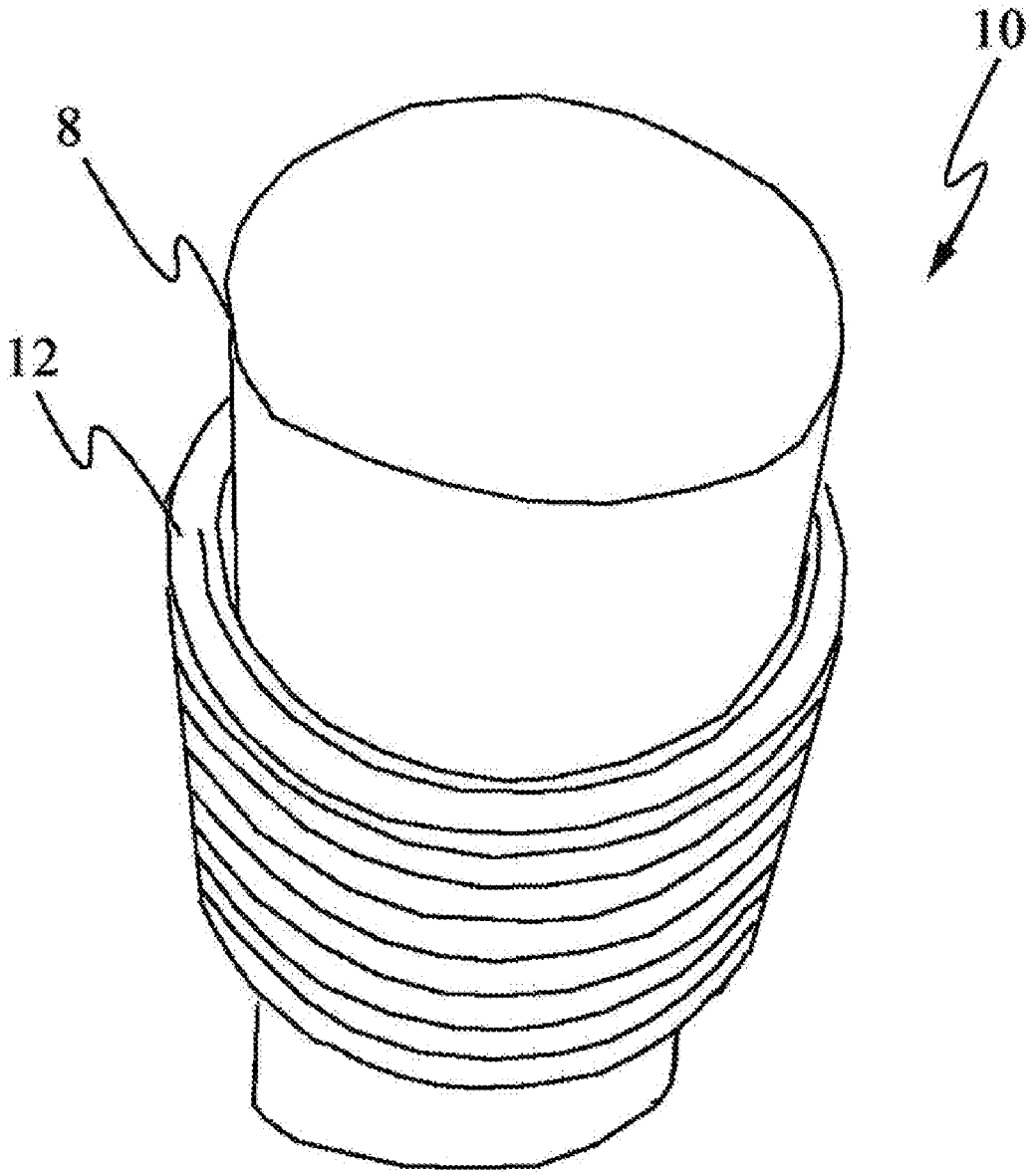
FIG. 2 is a side perspective view of the pile saver depicted in FIG. 1 with a pile extending through such pile saver device.

Referring now to FIG. 1, a side perspective view of one exemplary embodiment of a pile saver (10) is presented. FIG. 1 depicts a pile saver device (10) comprising a cylindrical housing (12) defining an elongated body (14) disposed about the longitudinally extending axis (16) wherein said elongated body (14) further defines and inner void (18) (bore) extending through the length of the housing thereby defining a hollow tube structure. Elongated body (14) has an outer housing surface (20) defined by the exterior outline of housing (12) and an interior housing surface (22) defined by the interior outline of the housing (12). It should be appreciated that inner void (18) is also cylindrical in shape having a predefined diameter (24) suitably sized for receiving pile (8) as depicted in FIG. 2. Interior housing surface (22) further defines a housing-pile interface configured for rubbing against the outer surface of Pile (8). Predefined diameter (24) is selected so that the housing-pile interface is movably and cleanably associated with the outer surface of pile (8). Exemplary embodiments of a housing-pile interface include a ribbed (similar to the outside housing surface) or smooth section associated with or defined by interior housing surface (22).

It should be noted that outer housing surface (20) may be coated with a protectant such as an anti-bio fouling paints which prevent marine growth from forming. This coating consists of marine paint mixed with biodegradable, non-toxic, environmentally friendly agents derived from plants. The active ingredient in the additive is capsaicin which is found in many plants including cayenne pepper and other plants of the capsicum genus.

For the presently preferred embodiment, the perimeter of housing (12) defines a plurality of hollow circular tubes (21) wherein at least one side of each tube (21) is mechanically associated with the side of an adjacently disposed tube (21) thereby defining a plurality of tube junctions (23, FIG. 6) and forming cylindrical elongated body (14) defined by a corrugated outer wall having alternating, axially-adjacent, annular crests and valleys. One exemplary housing (12) is constructed from polyurethane industrial grade culvert pipe with a solid wall interior. For a typical pile application, housing (12) will have an inside diameter of about 10 inches and the outside of about 12 inches with an overall length of about 10 inches. It should be appreciated that longer and shorter housing (12) lengths may be used without departing from the scope of the invention.

Figure 3:
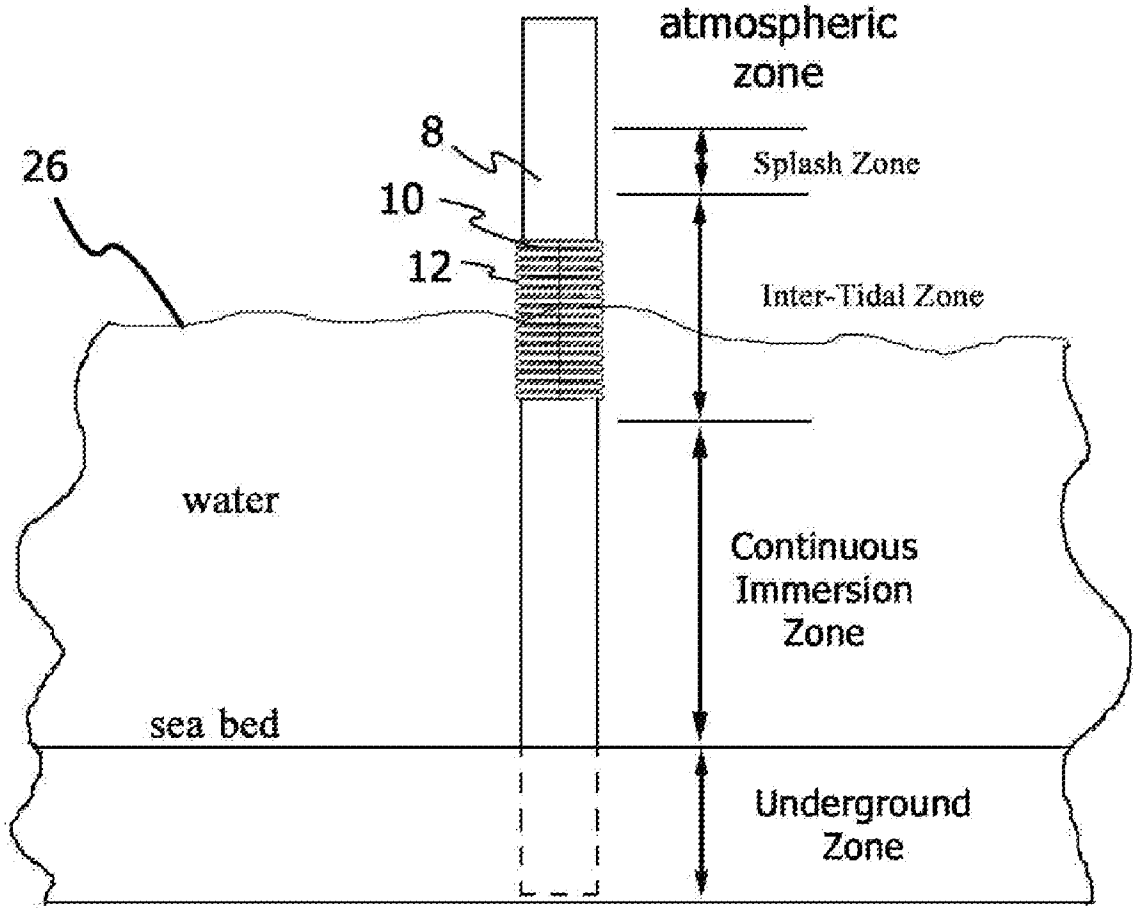
FIG. 3 is a side view of the pile saver depicted in FIG. 1 associated with a pile in a marine environment while also depicting the different deterioration zones.

Referring now to FIG. 3, a side view of pile saver (10) embodiment depicted in FIG. 1 and FIG. 2 is presented showing pile saver (10) associated with a pile (8) in a marine environment. As depicted in FIG. 3, such marine piles are typically driven into the ground and come in direct contact with air, dirt, and water, thereby providing several different "deterioration zones" including the: (1) atmospheric zone; (2) splash zone; (3) intertidal zone; (4) continuous immersion zone; and (5) underground zone. Each zone has its own deterioration factors that need to be considered when considering how to extend the useful life of a marine pile. Pile saver (10) is particularly well suitable for cleaning/preventing marine growth in the inter-tidal zone although alternative embodiments may also provide such a function in at least part of the splash zone and continuous immersion zone.

It should be appreciated that the exemplary embodiment of the invention depicted in FIG. 1 and FIG. 2 comprises a cylindrical housing (12) having a predefined diameter (24) suitably sized for receiving pile (8) and tightly wrap around such pile providing a predefined housing-pile gap between the pile and housing (12). For the present embodiment, such housing-pile gap is about one-sixteenth of an inch to about one-eighth of an inch. The housing-pile gap is selected to be loose enough to allow the housing (12) to move up and down pile (8) as the water lever (26) varies but snug enough to remove, or prevent the accumulation of, unwanted material on the side of pile (8). To provide a buoyant force that supports pile saver (10) so that about half of housing (12) is above the water line (26), at least one of the tubes of housing (12) is constructed from or associated with a buoyant material. For one exemplary configuration, at least one of the hollow circular tubes defined by housing (12) is at least partially filled with a buoyant material such as a slow-rising multipurpose polyurethane foam. Methods of adding buoyancy to the pile saver (10) device will be better defined below. Additionally, the end points of each tube that is filled with a buoyant material may further be sealed with a sealant to protect the buoyant material. On exemplary embodiment of such a sealant is Liquid Nails®.

One of ordinary skill in the art will appreciate that such a configuration is one example of a pile saver (10) that is movably and cleanably associated with the outer surface of pile (8). As noted above, for the purposes of this document, two items are movably and cleanably associated with one another when relative movement between the two items performs at least one of: (a) removes a substance from one of the items; and (b) prevents the substantial accumulation of a substance on one of the items.

Pile Savers for Non-Round Piles

Figure 4:
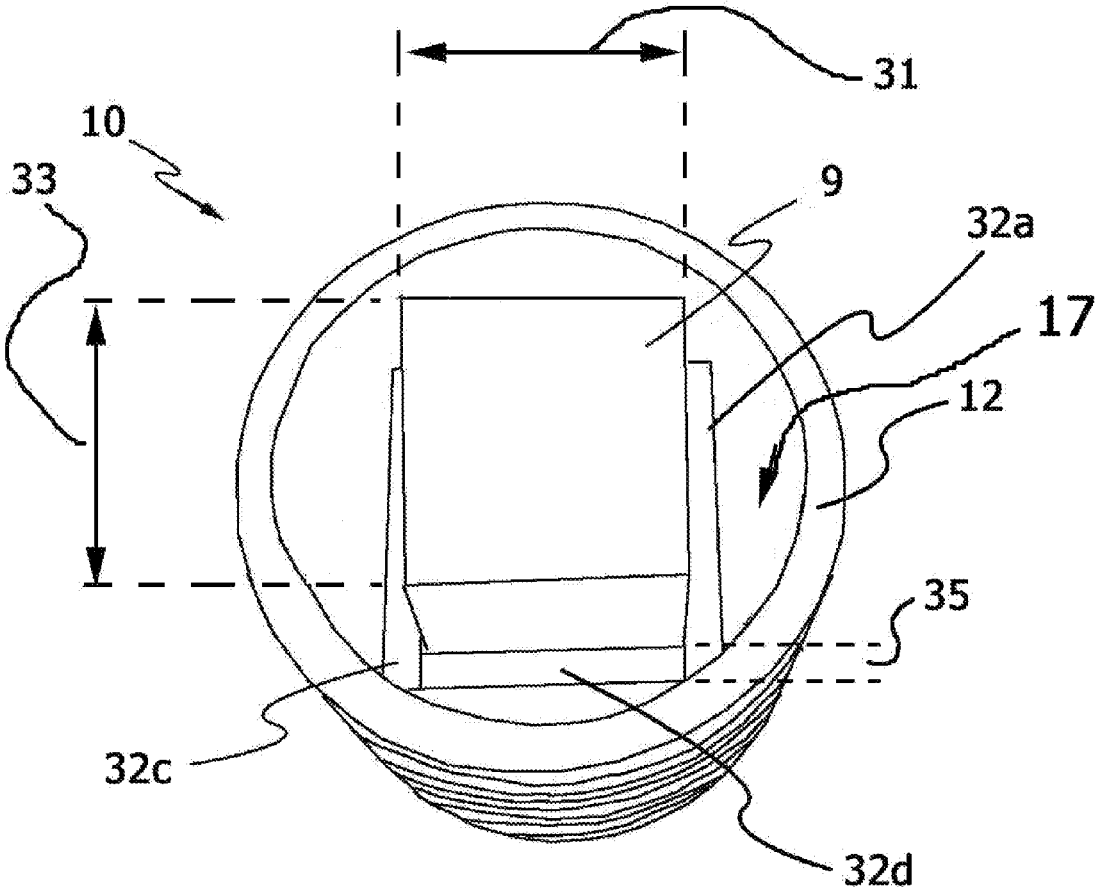
FIG. 4 is a top perspective view of one alternative embodiment of a pile saver comprising a shell associated with a protective housing.
Figure 5:
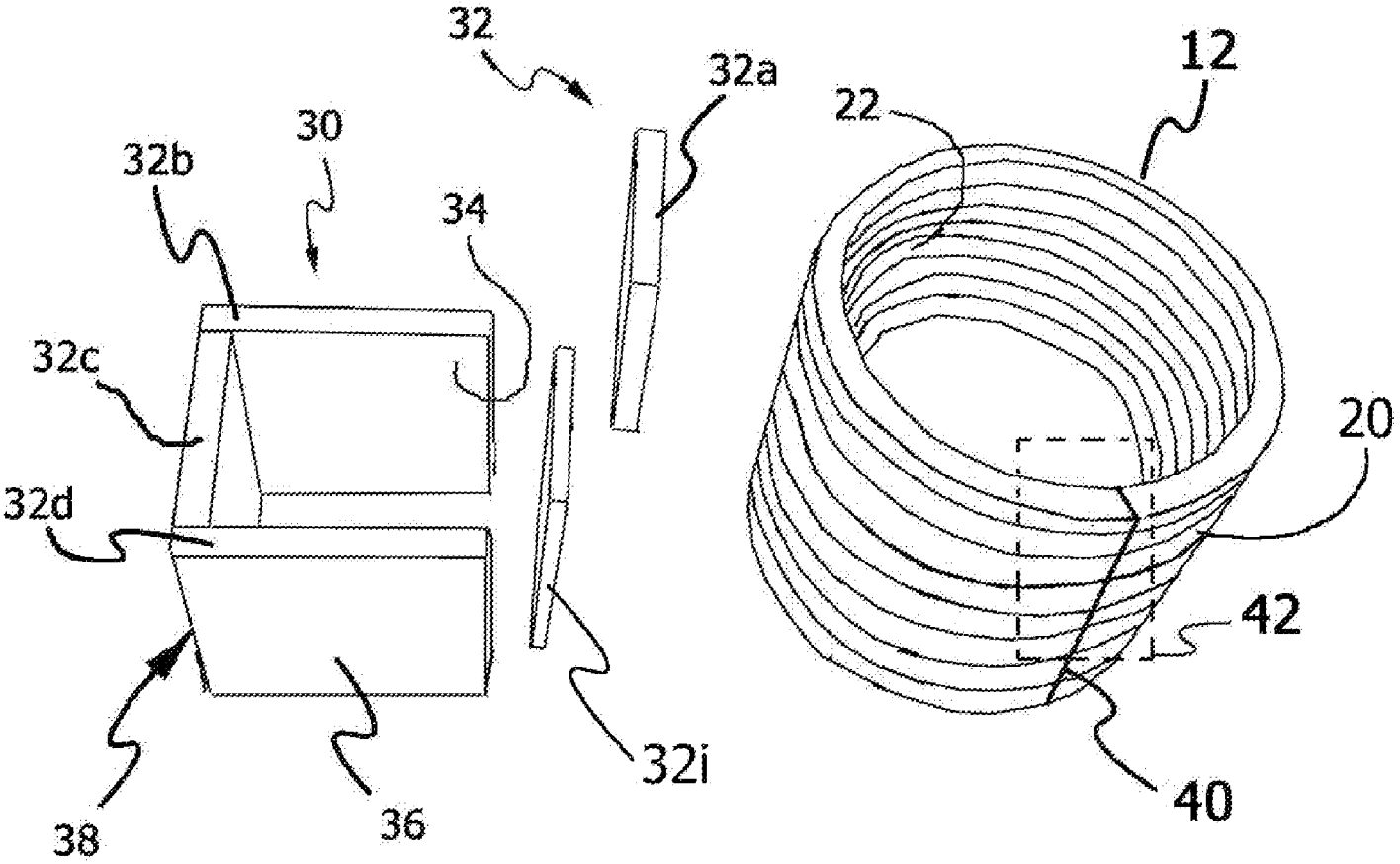
FIG. 5 is a side perspective view of the components of the pile saver depicted in FIG. 4.

Notably, not all piles used in marine environments have an outside perimeter that defines a circular shape. Indeed, a significant number of piles used in marine environments have an outside perimeter that defines a polygonal shape such as a rectangle. Referring now to FIG. 4 and FIG. 5, a top perspective view of one exemplary alternative embodiment of a pile saver (10) device is presented. For such alternative embodiment, pile saver (10) comprises an internal shell (30) configured for being associated with a pile having an outside perimeter that defines a polygonal shape. For such embodiment, housing (12) has the same basic configuration as described above. One exception is that instead of defining a housing-pile interface, interior housing surface (22) defines a shell-interface. Such shell-interface is configured for being mechanically associated with a housing-interface defined by shell (30) using attachment mechanisms such as glue and pro-choline coated screws. For such configuration, housing (12) provides protection for shell (30) and may also provide a buoyant force as described below.

For one embodiment, the shell-interface defined by housing (12) is simply an interface point (such as a hole) configured to receive an attachment mechanism (such as a screw) configured for mechanically attaching shell (30) to housing (12). One of ordinary skill in the art will appreciate that portions of housing (12) and shell (30) may be integrated into a single piece and the entire structure may be integrated into a single piece component without departing from the scope of this disclosure.

As can be seen in the exemplary embodiment presented in FIG. 4, the exterior perimeter defined by pile (9) defines a square shape; therefore, shell (30) comprises a structure that defines a square void through which pile (9) may be inserted wherein the size of shell (30) is selected to provide a predefined shell-pile-gap. Restated, shell (30) defines a hollow polygonal shape defining an internal shell perimeter that is substantially consistent with the polygonal shape defined by the exterior parameter of a pile (9) and wherein said hollow polygonal shape is suitably sized to provide a predefined shell-pile-gap (the gap between the interior-shell surface (34) and the exterior pile surface defined by pile (9)) when pile (9) is extended through such hollow polygon shape.

As best seen in FIG. 5, for the current exemplary embodiment, shell (30) comprises a plurality of shell-walls (32). Shell-walls (32) define four rectangular boards/plates wherein each rectangular board defines an inner-shell surface (34) and an outer-shell surface (36). As seen best in FIG. 4, two shell-walls (32*a*, 32*c*) have a length approximately equal to the length (33) defined by pile (9) plus the distance (35) defined by the thickness of shell-wall (32*b*) plus the similar distance defined by shell-wall (32*d*). The remaining two shell-walls (32*b*, 32*d*) have a length approximately equal to the length (31) defined by pile (9). As noted above and as one of ordinary skill in the art will appreciate, such shell-wall (32) lengths are selected so that such a plurality of shell-walls (32) may be mechanically associated together to form a square box shape defining a square void through which pile (9) may be inserted (as depicted in FIG. 4) while providing a predefined shell-pile-gap thereby moveably and cleanably associating shell (30) with pile (9).

For one alternative embodiment, shell-walls (32) are further configured for being associated with wall inserts (32*i*). For such configuration, at least one shell-wall (32) is associated with a wall insert (32*i*) so that such wall insert (32*i*) covers the inter-shell surface (34) for the associated shell-wall (32) and acts as a "shim" to achieve the previously described predefined shell-pile-gap. As one of ordinary skill in the art will appreciate, one surface of insert (32*i*) preferably is configured for rubbing against and cleaning pile (9).

Shell (30) may be constructed from any suitable material; although such material is preferably rust resistant or rust proof. One such material is thermoplastic polymer such as polyvinyl chloride. For such embodiment, the shell (30) plates are mechanically associated to each other using glue suitable for associating two polyvinyl chloride pieces together. The PVC box pieces are suitably sized

Pile Saver Assembly

For new pile installations, pile saver (10) may be a completely assembled device configured to be associated to the pile before other items (such as dock hardware) are associated with such pile that would prevent such association. It should be appreciated, however, that there are many situations where a completely assembled pile saver (10) device cannot be associated with a pile due to some obstruction. For such situations, a pile saver (10) assembly is provided that may be assembled and associated with the pile on site (i.e. where the pile is installed in a marine environment complete with "obstructions"). FIG. 5 depicts a pile saver (10) assembly comprising a housing (12) and separate shell (30). Housing (12) and shell (30) are separate components that are to be assembled at the pile site.

Shell (30) component comprises a partially completed box structure with at least one shell-wall (32) not being associated with the assembled shell-walls (32). For the square shaped shell depicted in FIG. 5, one shell-wall (32) has not been associated with the other three assembled shell-walls (32). Such a configuration allows incomplete shell (30) to be inserted around pile (9) allowing the remaining shell-wall (32) to be mechanically associated with shall (30) thereby completing the assembly the shell (30) component with the pile (9) extending through the void defined by shell (30).

Similarly, housing (12) defines a cut (40) extending from the bottom of housing (12) to the top of housing (12) thereby allowing housing to be spread apart to fit around the pile (9). After the housing has been associated with pile (9), it is slipped over shell (30) so that the shell-interface defined by housing (12) is in alignment with housing-interface defined by shell (30). The housing-interface and shell-interface are then mechanically associated using an attachment mechanism such as glued, rust proof screws, and vinyl wrapping.

Providing a Buoyant Force

As noted above (and best seen in FIG. 3), pile saver (10) is configured to be associated with a pile that has been installed in a hostile environment such as a marine environment. For a marine environment, marine piles are typically driven into the ground and come in direct contact with air, dirt, and water, thereby providing several different "deterioration zones" including the: (1) atmospheric zone; (2) splash zone; (3) intertidal zone; (4) continuous immersion zone; and (5) underground zone. Each zone has its own deterioration factors that need to be considered when considering how to extend the useful life of a marine pile. Pile saver (10) is particularly well suitable for cleaning/preventing marine growth in the inter-tidal zone although alternative embodiments (such as longer pile saver devices and associated shell bodies) may also provide such a function in at least part of the splash zone and continuous immersion zone.

As noted above, pile saver (10) is to have a buoyant force that supports pile saver (10) so that about half of housing (12) is above the water line (26) (as depicted in FIG. 3). One of ordinary skill in the art will appreciate that there are numerous methods of providing pile saver (10) with such a buoyant force. For example, housing (12) is constructed from and/or associated with a buoyant material.

Figure 6:
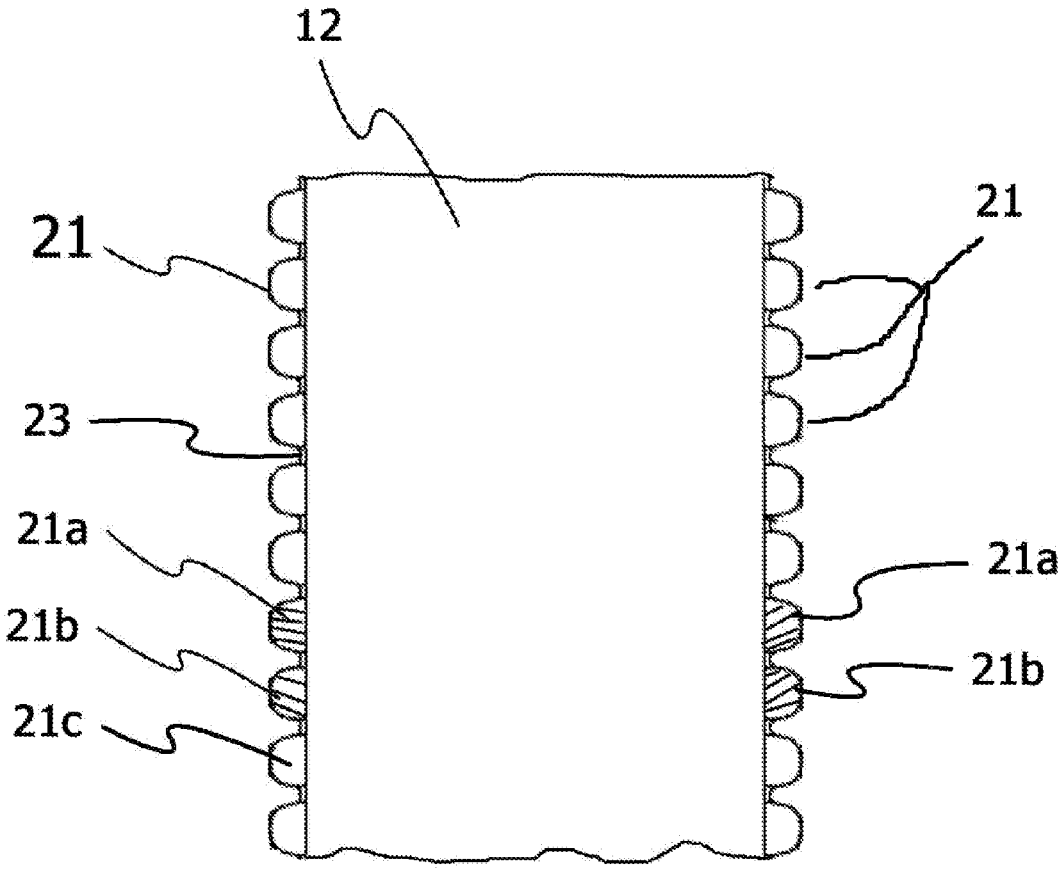
FIG. 6 is a side cut away view of the housing depicted in FIG. 1 and FIG. 2.
Figure 7:
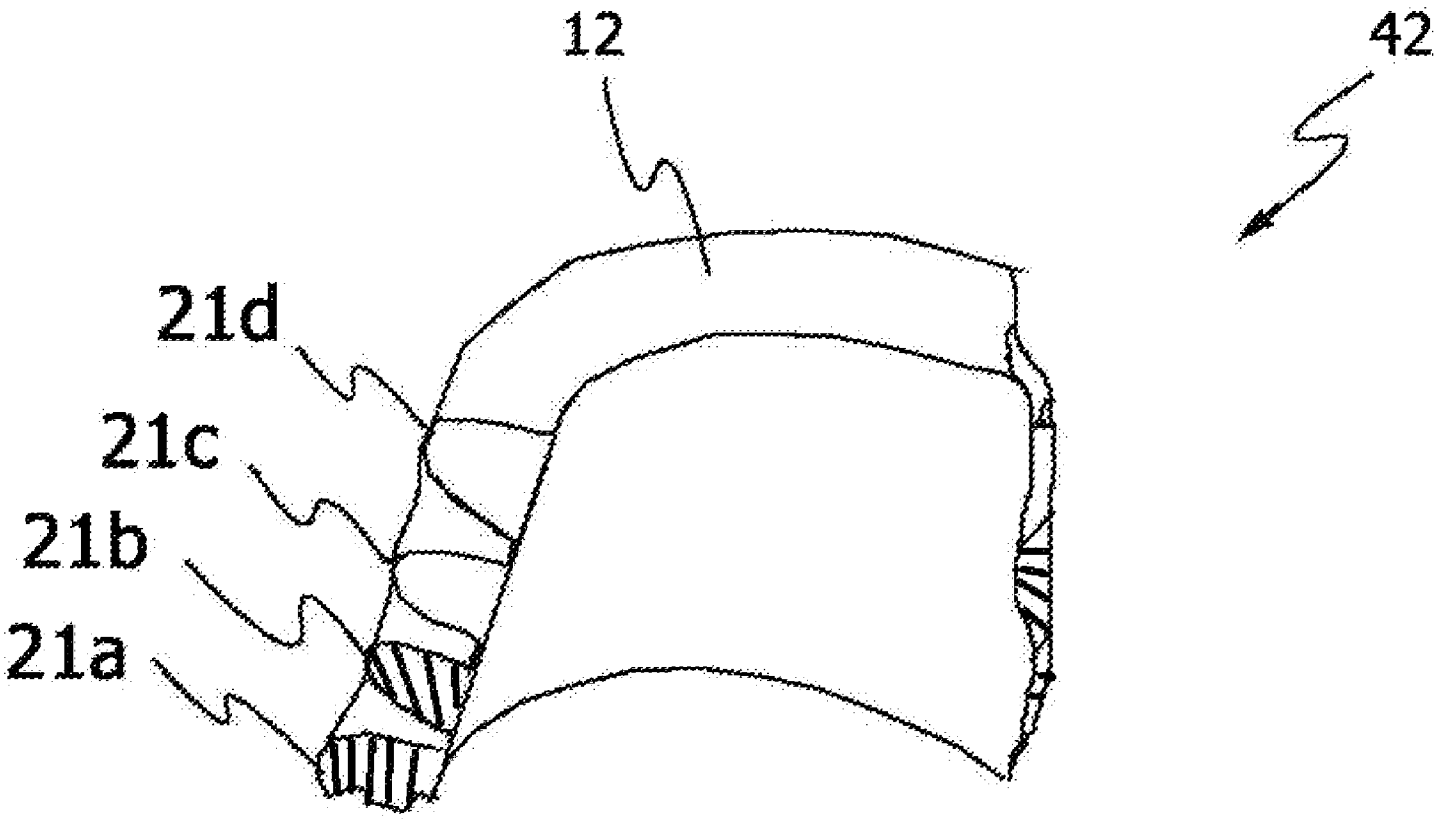
FIG. 7 is cut away section 42 as depicted in FIG. 5 revealing a partial view of the inside of a housing.

Referring now to FIG. 6 and FIG. 7, one exemplary method of providing pile saver (10) device with a buoyant force is presented. FIG. 6 presents a cut away, side view of the housing (12) depicted in FIG. 1 and FIG. 2 while FIG. 7 presents a cut away view of section 42 depicted in FIG. 5 revealing a partial view of the inside of hollow circular tubes (21) of housing (12). For one exemplary configuration, at least one of the hollow circular tubes (21) defined by housing (12) is at least partially filled with a buoyant material such as a slow-rising multipurpose polyurethane foam. Additionally, the end points of such tubes may be sealed with a sealant to protect the buoyant material. As depicted in FIG. 6 and FIG. 7, hollow circular tubes (21*a*) and (21*b*) are completely filled with polyurethane foam. Additionally, the cavity defined by the space (17, see FIG. 4) between housing (12) and shell (30) may be filled with a buoyant material such as polyurethane or Styrofoam® to add buoyancy. For the currently preferred embodiment, housing (12) is constructed from a polypropylene material and shell (30) is constructed from a polyvinyl chloride material, both materials already providing a buoyant force. Preferably, the buoyant force is great enough to allow pile saver (10) to float (about halfway to two-thirds submerged) in a manner as to allow for the maximum effect of the rubbing of the piling.

The pile saver device is operated by associating it with a pile so that it is free to move along such pile as water level varies causing the pile saver (10) to rub the section of the pile located in at least the tidal zone of the pile. The device rubs to piling preventing Marine growth from attaching and damaging the piling in this area is effectively extending the life of the piling for as many as 10 plus years. It also keeps the damage of the sharp Marine life, which can injure swimmers, boats, and the like, from forming.

Figure 8:
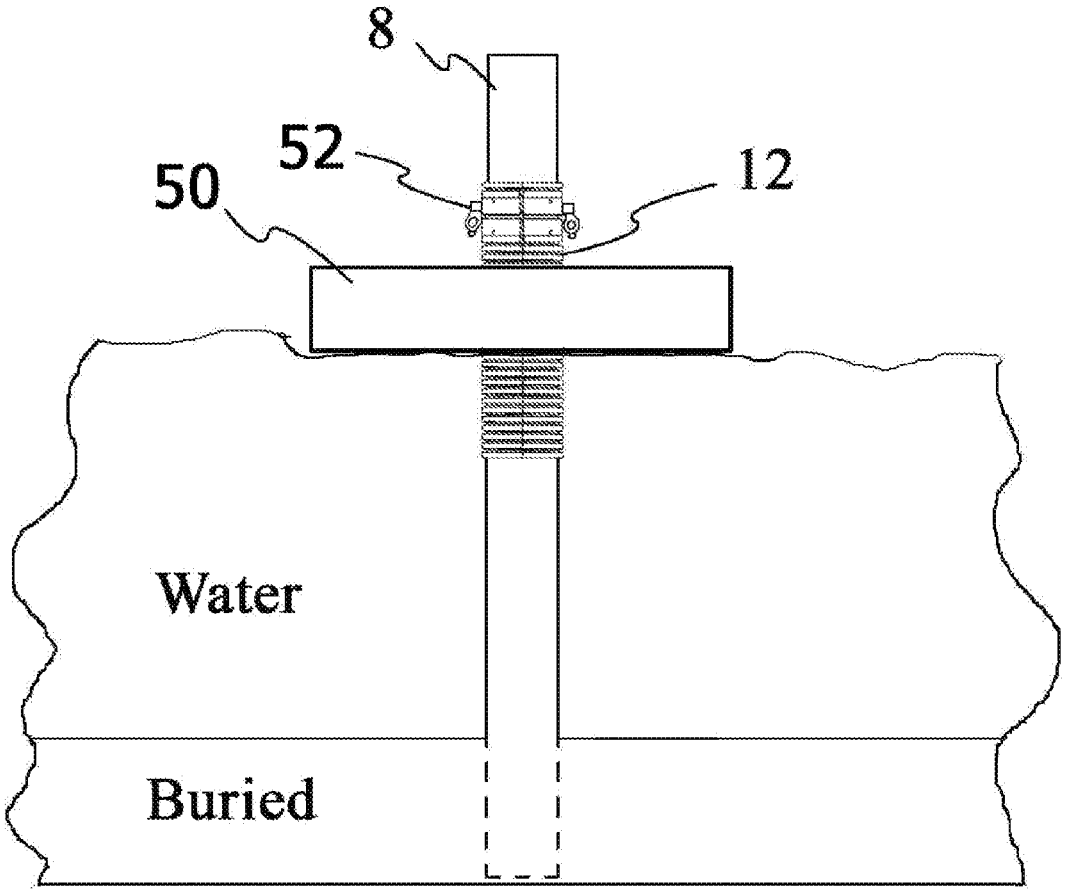
FIG. 8 is a side view of the pile saver in FIG. 4 associated with a dock.
Figure 10:
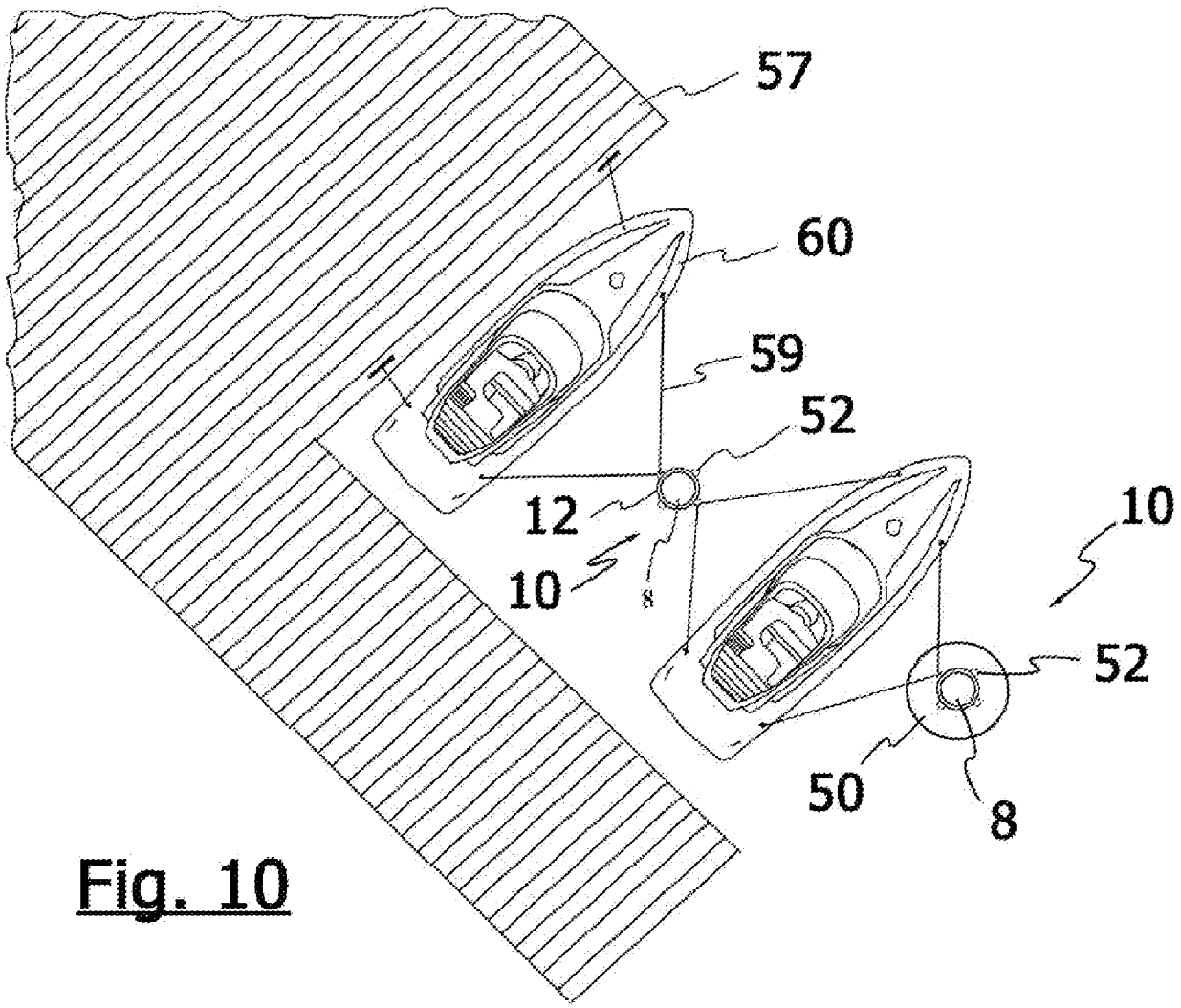
FIG. 10 is a top view of one exemplary system using two different pile saver configurations.

FIG. 8 presents yet another embodiment of pile saver (10) where housing (12) is configured for being associated with a floating device (50) such as a floating dock. For such configuration, housing (12) is mechanically associated with a buoyant dock (30) providing sufficient buoyancy so that dock (30) floats on top of water. Such a configuration may further be associated with mooring points (52) configured for receiving a mooring line from a vessel or other item that needs to be moored. As depicted in FIG. 10, one utilization of such a pile saver (10) configuration is presented where boats (60) are moored at a pier (57). Additionally, dock (50) may be a platform designed for recreational activities.

Figure 9:
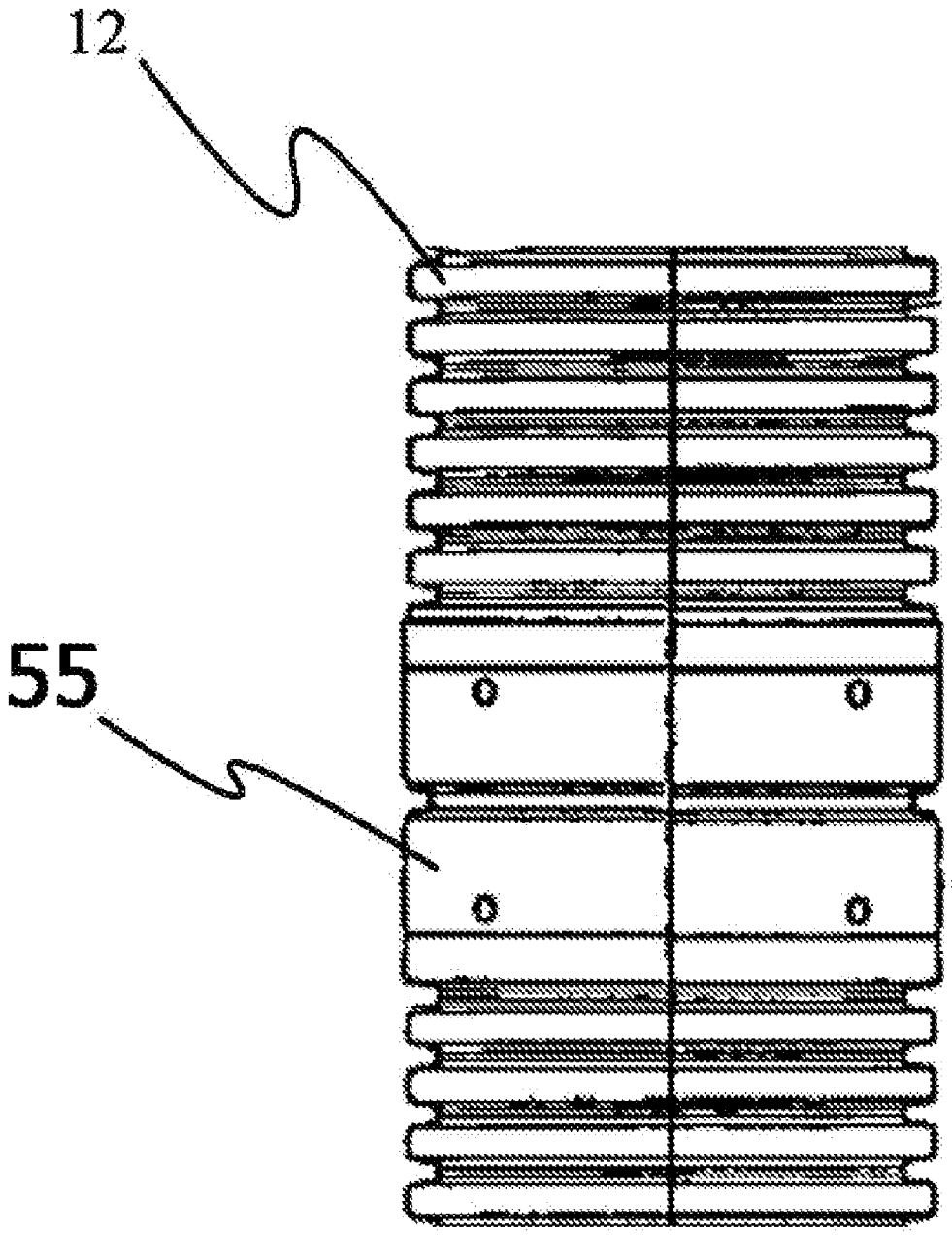
FIG. 9 is a side view of two pile saver devises depicted in FIG. 1 associated together by a coupling.

Referring now to FIG. 9, one method of extending the length of pile saver (10) is presented. For this currently preferred configuration, two pile saver (10) devices are mechanically associated with a coupling (55). One suitable coupling technology is taught by Goddard in U.S. Pat. No. 7,451,784 (incorporated by this reference for all that it discloses). Such a configuration allows for easy transport of several pile saver (10) devices and mechanically associated to get at an installation site. As noted above, making pile saver (10) longer is one method of providing a larger cleaning zone.

Electronic Modules

Figure 11:
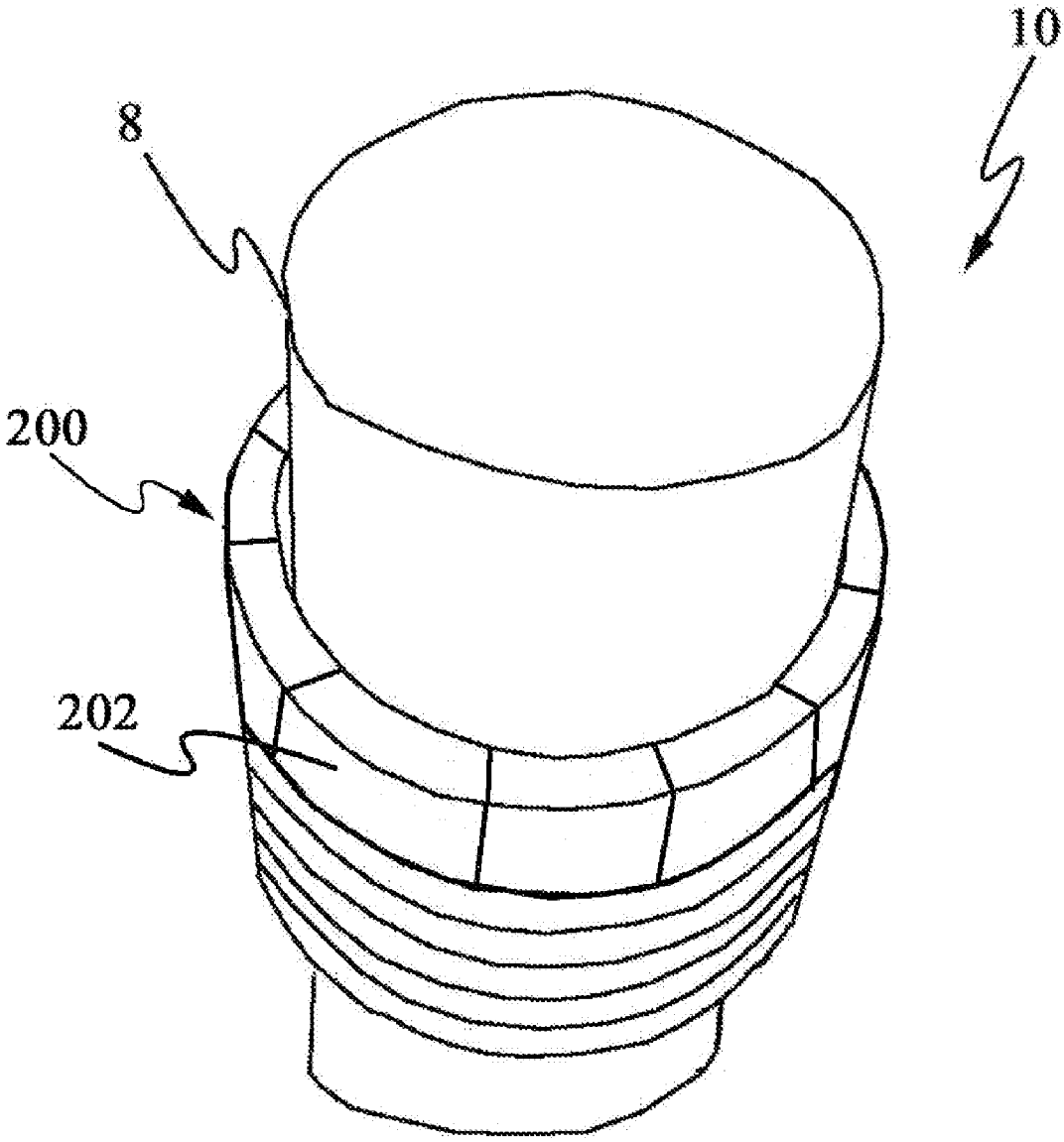
FIG. 11 is a side perspective view of the pile saver depicted in FIG. 2 associated with an electronic module.

FIG. 11 presents an embodiment of the invention comprising an electronic module. For the current embodiment, electronic module (200) is associated with the top of pile saver device (10) although any location along pile saver (10) may be used. Additionally, the pile saver (10) housing may define the electronic module housing. As shown in FIG. 11, for the current embodiment, electronic module (200) comprises a plurality of sections that surround pile (8).

Electronic module (200) comprises a processing device, such as a PIC, electrically associated with a memory. Such memory is at least one of electrically associated with said processing device and integral to said processing device. The processing device is further electrically associated with at least one of: (a) power source; (b) one or more sensors; (c) a recharger; (d) a signaling device; (e) a transmitter; and (f) a receiver.

For embodiments comprising at least one sensor, such sensor is electrically associated with said processing device, wherein said sensor is configured for providing sensor-signals to said processing device. Generally speaking, a sensor is a device that tells something about its environment typically using a transducer which converts a parameter at a test point to a form suitable for measurement by a sensor circuit. Stated another way, a sensor is a device which is designed to produce a signal or offer an indication in response to an event or stimulus within its detection zone. An electronic sensor is a sensor that provides such information by creating an electrical signal. Electronic sensors are so numerous and diverse that describing all possible sensor types and associated parts that may be used would fill volumes and is beyond the scope of this document. Additionally, sensor technologies are known and understood by those skilled in the art, and a detailed explanation thereof is not necessary for purposes of describing the method and system according to the present invention.

For the current embodiment of pile saver (10) comprising sensors, such sensors are mechanically associated with pile save (10) and/or electrically associated with said pile saver (10) device via a direct or wireless electrical association. Such sensor are preferably electrically associated with said processing device and are configured for sensing an environmental parameter and further configured to generate sensor-signals indicative of the monitored environmental parameter and further configured to electrically communicate said sensor-signals to said processing device or other external processing devices.

Environment sensors are one or more electronic sensors configured for monitoring a particular attribute associated with pile saver box (10)'s environment. Such attributes include (a) a chemical sensor (such as chlorine) that generates sensor signals indicative of the existence of a chemical; (b) a temperature sensor that generates a sensor-signal indicative of a measured temperature in the vicinity of the sensor, (c) water level sensor configured for generating sensor-signals indicative of the water level of around pile saver (10); (d) a light sensor configured for generating sensor-signals indicative of the amount of light in the vicinity of the light sensor; (e) pH sensor configured for generating sensor-signals indicative of the pH level of the water around pile saver (10); and (f) turbidity sensor configured for generating sensor-signals indicative of the water's turbidity.

Warning-criteria, such as low water level, may be stored in the memory associated with the processing device. Such warning-criteria may further include a function to perform with such criteria are detected. The processing device may be configured to monitor sensor-signals generated by the various sensors and issue warnings when the processing device determines a sensor-signal satisfies a warning-criteria condition. For example, pile saver (10) may be configured so that the processing device is electrically associated with a water level sensor and further configured to generate a warning when the water level around the pile saver (10) is at a predefined level. Then processing device may been perform a function defined/associated with the warning-criteria, such as activating a signaling device (such as a light signal).

The processing device my further be configured to provide data logging services wherein sensor data is stored in memory. Such stored sensor data may be time stamped. The processing device may also perform data-functions comprising at least one of (a) transmitting at least part of said data to a remote receive, (b) storing said data in said memory, and (c) performing data-management routines using at least part of said data.

Other sensor technologies include a light sensor configured for generating sensor-signals indicative of the amount of light in the vicinity of the light sensor. Such a sensor may be used to determine the type of warning issued. For example, during daylight hours, the processing may not issue a visual signal or may issue a different visual signal that is issued during dark hours.

While the present subject matter has been described in detail with respect to specific embodiments thereof, it will be appreciated that those skilled in the art, upon attaining an understanding of the foregoing may readily adapt the present technology for alterations to, variations of, and equivalents to such embodiments. Accordingly, the scope of the present disclosure is by way of example rather than by way of limitation, and the subject disclosure does not preclude inclusion of such modifications, variations, and/or additions to the present subject matter as would be readily apparent to one of ordinary skill in the art.

What is claimed is:

1. A pile saver apparatus configured for minimizing marine growth on a pile, said apparatus comprising:

a shell comprising a plurality of internal shell surfaces and opposing external shell surfaces wherein said shell defines a hollow polygonal shape defining an internal shell perimeter that is substantially consistent with the polygonal shape defined by the exterior perimeter of a pile and wherein said hollow polygonal shape is suitably sized to provide a predefined shell-pile-gap when said pile extends through said hollow polygon shape;

wherein at least one of said external shell surfaces defines a shell-interface configured for being associated with a housing-interface;

wherein said plurality of internal shell surfaces define at least one pile interface configured to rub against a surface of said pile;

wherein said predefined shell-pile-gap is suitable for allowing said shell to move vertically relative to said pile so that said at least one pile interface defines a cleaning-association with an exterior surface of said pile;

a housing defining at least one internal housing surface and at least one external housing surface, wherein said at least one internal housing surface defines a housing-interface suitably configured for being associated with said shell-interface and wherein said housing is suitably sized to extend around at least part of said shell; and wherein at least one of said housing and said shell are one of (a) constructed of, and (b) associated with, a material that results in a buoyant force being generated by a fluid surrounding at least a portion of said pile.

2. A pile saver apparatus as in claim 1, wherein said hollow polygonal shape defines a substantially rectangular shape and wherein said shell-pile-gap is between about one-sixteenth to about one-eighth of an inch.

3. A pile saver apparatus as in claim 2, wherein said housing defines a cylindrical housing constructed from polyurethane industrial grade culvert pipe with a solid wall interior and wherein the inside diameter of said housing is about ten inches and the outside diameter of said housing is about 12 inches.

4. A pile saver apparatus as in claim 3, wherein the length of said housing is approximately ten inches and wherein said housing fully surrounds said shell.

5. A pile saver apparatus as in claim 4, wherein said shell is constructed from four PVC plates attached together to form a substantially rectangular shell.

6. A pile saver apparatus as in claim 5, wherein two of said PVC plates are about five and seven-eighths inches wide by six inches long and where in two of said PVC boards are about five and seven-eighths inches wide by six inches long.

7. A pile saver apparatus as in claim 5, wherein the housing interface is associated with the shell interface using glue and pro-choline coated screws.

8. A pile saver apparatus as in claim 4, wherein said housing defines a cut from top to bottom thereby allowing (a) the housing to be spread apart and said buoyant material to be inserted inside a void defined by said housing, and (b) wrapped around said pile and slipped over said shell.

9. A pile saver apparatus as in claim 1, further comprising an electronic module comprising a processing device associated with a power source and a memory and at least one sensor configured for generating signal signals representing sensor data.

10. A pile saver apparatus as in claim 9, wherein said memory stores a plurality of warning criteria and warning function data pairs and wherein said pile saver device further comprises a signaling device electrically associated with said processing device and wherein said processing device is configured to monitor the sensor signals generated by said at least one sensor and activate said signaling device to perform a warning function when the processing device determines the monitored sensor signals satisfy a warning criteria condition.

11. A pile saver apparatus as in claim 9, further comprising a transmitter electrically associated with said processing device and wherein said processing device is further configured to use said transmitter to transmit sensor data to a remote location.

12. A pile saver apparatus as in claim 9, further comprising a transmitter electrically associated with said processing device and wherein said processing device is configured to transmit a data signal that comprises location data that is one of (a) stored in said memory and (b) generated by a sensor electrically associated with said processing device, wherein said location data can be used by a mobile remote device to determine its location.

13. A shell configured to be movably associated with a pile at least partially submerged in a fluid, said shell comprising:

a plurality of shell-walls defining a plurality of inter shell surfaces and opposing outer shell surfaces, said shell-walls mechanically associated with each other to define a polygonal void that is a predefined amount larger than the polygonal shape defined by the exterior surface of a pile thereby defining a shell-to-pile-gap when said pile is extended through said polygonal void;

wherein at least one inter shell surface defines a pile surface interface;

wherein said shell is constructed of at least one material that results in a buoyant force being exerted on such shell when said shell comes in contact with said fluid; and wherein the shell defines a body that displaces enough of said fluid so that said buoyant force supports said shell in said fluid causing said shell to move along said pile as the level of said fluid varies thereby causing said at least one pile surface interface to define a cleaning relationship with a surface of said pile.

14. A shell as in claim 13, wherein said shell is further configured with an electronic module comprising a processing device associated with at least one of an integral memory and an external memory, said processing device further electrically associated with at least one sensor and a signaling device.

15. A shell as in claim 14, wherein said outer perimeter of said pile defines a substantially square polygonal shape defining four pile-sides and wherein said plurality of shell-walls comprise a first shell-wall pair and a second shell-wall pair, wherein the width of the shell-walls in the first shell-wall pair is longer than the width of the shell-walls in the second shell-wall pair and wherein the width of the shell-walls in said second shell-wall pair are longer than the width of a pile-side.

16. A shell as in claim 15, further comprising a housing defining at least one internal housing surface and at least one external housing surface, wherein said at least one internal housing surface defines a housing-interface suitably configured for being associated with said shell and wherein said housing is suitably sized to extend around at least part of said shell.

17. A shell as in claim 14, wherein said sensor is at least one of: (a) a chemical sensor that generates sensor signals indicative of the existence of a chemical; (b) a temperature sensor that generates a sensor signal indicative of a measured temperature in the vicinity of the sensor, (c) water level sensor configured for generating sensor-signals indicative of the water level at said pile; (d) a light sensor configured for generating sensor-signals indicative of the amount of light in the vicinity of the light sensor; (e) a pH sensor configured for generating sensor-signals indicative of the pH level of the water around pH sensor; and (f) a turbidity sensor configured for generating sensor-signals indicative of the water's turbidity.

18. A shell as in claim 17, wherein said signaling device is one of a light generator and a transmitter and wherein said processing device is configured to monitor said sensor-signals and compare said sensor-signals to warning-criteria stored in said memory and wherein said processing device is configured to activated said signaling device based on the result of said sensor-signal /warning-criteria comparison.

19. A pile saver assembly configured for being assembled at a pile site, said pile saver assembly comprising:

a shell comprising a plurality of shell-portions, wherein each shell-portion comprises at least one shell-wall and wherein each shell-wall defines an inter shell surface and opposing outer shell surface, wherein a first shell-portion comprises a plurality of shell-walls mechanically associated with each other to define a first portion of a polygonal shell-void, wherein a second shell-section is composed of one of (a) a shell-wall configured to be mechanically with said first shell-section, and (b) a plurality of shell-walls mechanically associated with each other to define a second portion of a polygonal shell-void;

wherein each shell-wall is about 0.25 inches thick; and wherein said first shell-portion is configured to be mechanically associated with said second shell-portion thereby defining a complete polygonal shell-void that is larger than the polygonal shape defined by the exterior surface of said pile thereby defining a shell-to-pile-gap when said pile is extended through said polygonal void, said shell-to-pile-gap allows vertical movement of the shell along the pile when in use.

20. A pile saver assembly as in claim 19, further comprising a housing defining a cut extending from the bottom of the housing to the top of housing thereby allowing housing to be spread apart to fit around the pile and slipped over said shell.

* * * * *